US008084962B2

(12) United States Patent
van Beckhoven

(10) Patent No.: US 8,084,962 B2
(45) **Date of Patent: *Dec. 27, 2011**

(54) DRIVING CIRCUIT FOR LED

(75) Inventor: Steef van Beckhoven, Eindhoven (NL)

(73) Assignee: Lite-On It Corporation, Taipei (TW)

( * ) Notice: Subject to any disclaimer, the term of this patent is extended or adjusted under 35 U.S.C. 154(b) by 184 days.

This patent is subject to a terminal disclaimer.

(21) Appl. No.: 12/555,519

(22) Filed: Sep. 8, 2009

(65) Prior Publication Data

US 2010/0231141 A1 Sep. 16, 2010

Related U.S. Application Data

(63) Continuation-in-part of application No. 12/470,860, filed on May 22, 2009.

(30) Foreign Application Priority Data

Mar. 13, 2009 (CN) ..... 2009 1 0118481

(51) Int. Cl.
*H05B 37/02* (2006.01)

(52) U.S. Cl. ..... 315/307; 315/209 R; 315/225; 315/246; 315/291; 315/297

(58) Field of Classification Search ..... 315/219, 315/224, 225, 246, 247, 291, 294, 297, 307, 315/308, 209 R
See application file for complete search history.

(56) References Cited

U.S. PATENT DOCUMENTS

| | | | | |
|---|---|---|---|---|
| 7,259,525 | B2 * | 8/2007 | Yang | 315/291 |
| 7,439,945 | B1 * | 10/2008 | Awalt et al. | 345/83 |
| 7,880,404 | B2 * | 2/2011 | Deng et al. | 315/291 |
| 2008/0258695 | A1 * | 10/2008 | Kumar et al. | 323/223 |

* cited by examiner

*Primary Examiner* — Douglas W Owens
*Assistant Examiner* — Thai Pham
(74) *Attorney, Agent, or Firm* — Muncy, Geissler, Olds & Lowe, PLLC

(57) ABSTRACT

A driving circuit for LED includes: at least one LED; a light emission driving circuit having a first PWM unit and a power converting unit generating a driving current according to a signal generated by the first PWM unit and sending the driving current to the LED; a shunt parallel-connected with the LED; and a signal generating unit for generating a signal to switch on or off an electrical connection between the shunt and the light emission driving circuit. When the signal from the signal generating unit is at a high level, the electrical connection is switched on so that a majority of the residual driving current flows to the shunt.

5 Claims, 11 Drawing Sheets

DRIVING CIRCUIT FOR LED

CROSS REFERENCE TO RELATED APPLICATION

This application is a Continuation-in-Part of pending U.S. application Ser. No. 12/470,860, filed May 22, 2009. All disclosures of the application are incorporated herein by reference.

BACKGROUND OF THE INVENTION

1. Technical Field

The present invention relates to driving circuit for light-emitting diode (LED). More particularly, the present invention relates to a driving circuit that achieves instant LED current shutdown and linear control of the LED.

2. Description of Related Art

The so-called Pulse Width Modulation (hereinafter abbreviated as PWM) refers to a technique for converting analog signals into pulse signals. It primarily serves to monitor the output conditions of a power circuit and to provide signals for controlling electronic components. FIG. 1 shows a current signal converted into a pulse signal with a pulse width of tA in an ideal condition. The waveform of a PWM signal has a leading edge W1 and a trailing edge W2. The leading edge W1 reflects a toggle mode where the PWM signal rises to a high level from a low level, and the trailing edge W2 reflects another toggle mode where the PWM signal descends to the low level from the high level. The time consumed for completing the leading edge W1 is referred to as the rising time t1, and the time consumed for completing the trailing edge W2 is referred to as the falling time t2.

Referring to FIG. 2, it shows a practical PWM waveform of a control circuit. For a practical control circuit of an LED, the falling time t2 related to the trailing edge W2 of a PWM signal indicates the time the LED takes to turn off completely. In other words, when the waveform of the PWM signal is close to the ideal waveform of FIG. 1, the falling time is close to 0, meaning that the LED can be shut down immediately without any time delay. However, referring to the practical PWM waveform shown in FIG. 2, the trailing edge W2 of the PWM signal diverges from the ideal waveform of FIG. 1 so as to lead to undesirable delayed shutdown of the LED.

For instance, assuming the falling time t2 related to the trailing edge W2 of the PWM signal is 0.05 ms, it takes 0.05 ms for the LED to turn off completely. A blinking effect is resulted by delayed shutdown and the blinking effect is favorable only when the time interval i between two blinks is greater than 0.05 ms so that it can be recognized by human eyes. However, for a billboard composed of LEDs and configured to present animations or text scrolls, the delayed shutdown of the LEDs leave shadows around the animated patterns on the billboard and make the animations or text scrolls unrecognizable.

Please refer to FIG. 3, it shows a traditional circuit diagram of a driving circuit for LED. As shown in FIG. 3, the light emission driving circuit 10 serves to drive the LEDs 11. The light emission driving circuit 10 at least includes a PWM unit 12 and a power converting unit 13. For high power LED driver, a switch mode of the power converting unit 13 is used. The power converting unit 13 serves to rectify and regulate an AC power source to predetermined voltage and current values and then generates a driving current signal according to a high-level signal generated by the PWM unit 12. The driving current signal is provided to the LEDs 11 to drive the LEDs 11.

Referring to FIGS. 4*a* and 4*b*, they show that the LED current is stopped at time A-E in ideal and practical situations, respectively. In FIG. 4*a*, when the current is stopped at time A-E, the LED is shut down immediately without any time delay. Therefore, there is a clear difference between PWM width of time B, C and D in the short time. However, the driving current signal output by the power converting unit 13 has a relative slow leading and trailing edge because of the limited switch mode frequency of the power converting unit 13. The power converting unit 13 is used for low power consumption and low-cost driver which has disadvantage of the edge performance. As shown in FIG. 4*b*, when the LED current is stopped at time B, C or D, there is no difference between PWM width of time B, C and D compared with the ideal situation shown in FIG. 4*a*.

Referring to FIG. 5, it shows the relationship between the PWM step and the average LED current in FIG. 3. The brightness of the LEDs 11 is controlled by the current signal input to the LEDs 11. A smooth brightness control is needed so that people will not feel uncomfortable due to the suddenly change of the brightness of LEDs 11. However, in FIG. 5, it is not a smooth line nor shows a linear relationship because of the limited switch mode frequency. Because the current does not vary linearly with the PWM step, the control of the LEDs 11 is not accurate.

Hence, the present invention is herein proposed with the attempt to solve the existing problems mentioned above.

SUMMARY OF THE INVENTION

To remedy the aforementioned problems, one object of the present invention is to provide a driving circuit for instant LED shutdown and the other object is to provide a linear control of the LED. The driving circuit uses a shunt so that, upon turning off an LED, the majority of a residual current is led to the shunt, thereby expediting complete shutdown of the LED and resulting linear control of the LED.

For achieving this object, the driving circuit for LED comprises: at least one LED; a light emission driving circuit having a first PWM unit and a power converting unit, wherein the power converting unit generates a driving current according to a signal generated by the first PWM unit and sends the driving current to the LED; a shunt connected in parallel with the LED; and a signal generating unit for generating a signal to switch on or off an electrical connection between the shunt and the light emission driving circuit. When the signal generated by the signal generating unit is at a low level, the electrical connection between the shunt and the light emission driving circuit is switched off. When the signal generated by the signal generating unit is at a high level, the electrical connection between the shunt and the light emission driving circuit is switched on so that a residual current in the light emission driving circuit is led to the shunt.

According to the driving circuit for LED of the present invention, the resistance of the shunt is less than the resistance of the LED.

BRIEF DESCRIPTION OF THE DRAWINGS

The invention as well as a preferred mode of use, further objects, and advantages thereof will be best understood by reference to the following detailed description of illustrative embodiments when read in conjunction with the accompanying drawings, wherein.

DETAILED DESCRIPTION OF THE PREFERRED EMBODIMENT

Figure 6:
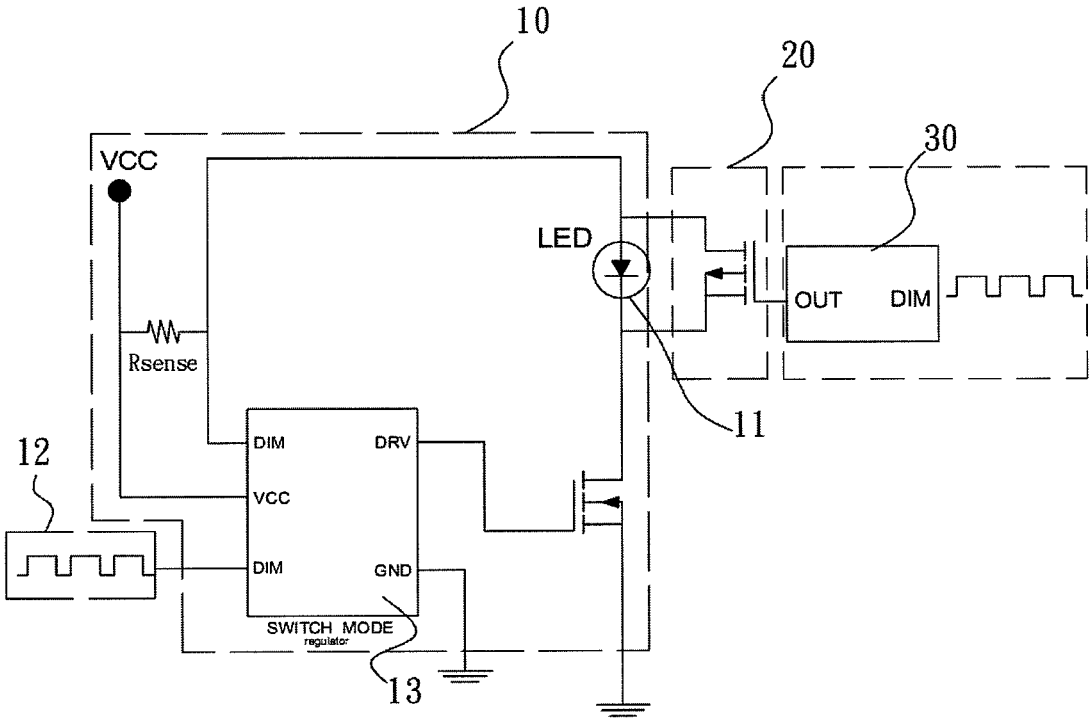
FIG. 6 is a circuit diagram of a driving circuit for LED according to a first embodiment of the present invention.
Figure 7:
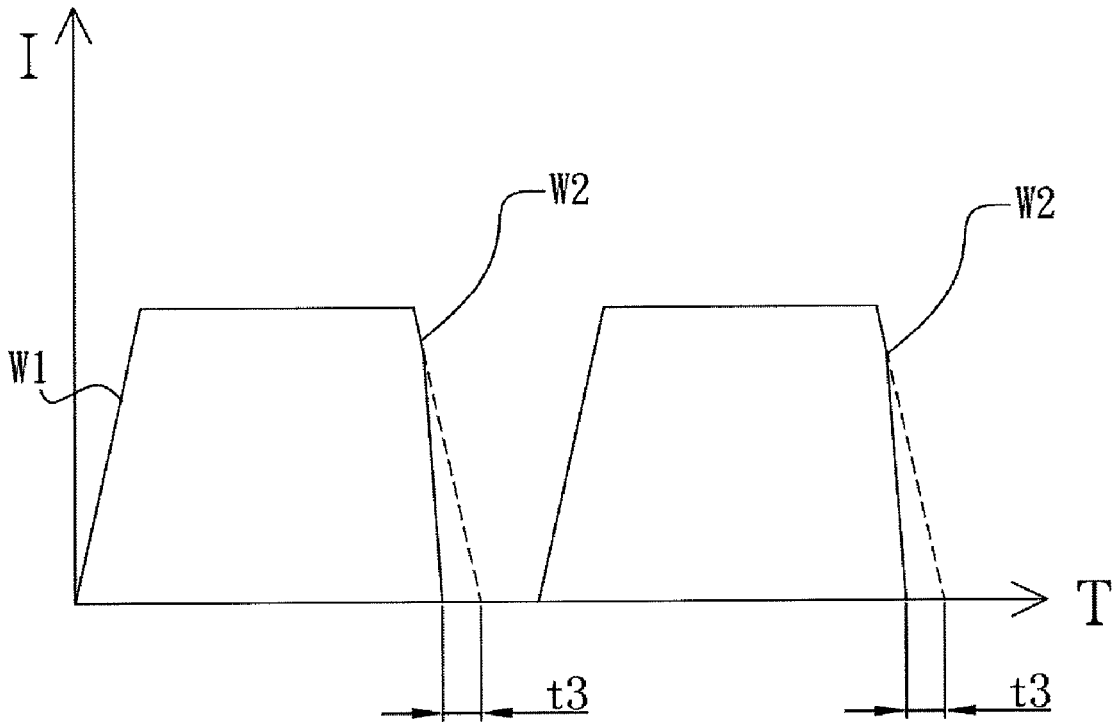
FIG. 7 is a waveform diagram showing the waveform of a PWM signal generated by the driving circuit of FIG. 6.

Please refer to FIG. 6, it shows a circuit diagram of a driving circuit for LED according to a first embodiment of the present invention and FIG. 7 shows a waveform diagram of a PWM signal generated by the driving circuit of FIG. 6.

As shown in FIG. 6, the disclosed driving circuit comprises a light emission driving circuit 10, a shunt 20, and a signal generating unit 30. The signal generating unit 30 in the embodiments can be the second PWM unit 30, for example. When the light emission driving circuit 10 turns off the LEDs 11, a signal generated by the second PWM unit 30 switches on an electrical connection between the shunt 20 and the light emission driving circuit 10. So that a residual current in the light emission driving circuit 10 is led to the shunt 20, thereby achieving instant shutdown of the LEDs 11.

The light emission driving circuit 10 serves to drive the LEDs 11. The number of LEDs in the LEDs 11 and the type of connections between the LEDs are not to be limited in the present invention and may be varied as needed. The light emission driving circuit 10 at least includes a first PWM unit 12 and a power converting unit 13. In this embodiment, the first PWM unit 12 and the second PWM unit 30 are synchronized. The power converting unit 13 serves not only to rectify and regulate an AC power source to predetermined voltage and current values, but also to generate a driving current according to a high-level signal generated by the first PWM unit 12. The driving current is sent to the LEDs 11 so as to drive the LEDs 11.

The shunt 20 is connected in parallel with the LEDs 11 and serves to shunt part of the residual current in the light emission driving circuit 10 to the shunt 20 upon turning off the LEDs 11, thereby shortening the time required for the LEDs 11 to be completely turned off. Whether the electrical connection between the shunt 20 and the light emission driving circuit 10 is switched on or off is controlled mainly by the second PWM unit 30. People skilled in the art can use another signal generating unit 30 to achieve the same function of the second PWM unit 30 described below. The signal generated by the second PWM unit 30 is at a level opposite to that of the signal generated by the first PWM unit 12. Moreover, when the signal generated by the second PWM unit 30 is at a low level, the electrical connection between the shunt 20 and the light emission driving circuit 10 is switched off, so that the driving current generated by the light emission driving circuit 10 drives the LEDs 11. When the signal generated by the second PWM unit 30 is at a high level, the electrical connection between the shunt 20 and the light emission driving circuit 10 is switched on, so that the current of the light emission driving circuit 10 is led to the shunt 20, thereby speeding up shutdown of the LEDs 11.

Referring to FIG. 6 again, the electrical connection between the light emission driving circuit 10 and the shunt 20 is switched on mainly to divert the majority of the residual current in the light emission driving circuit 10. According to Ohm's law (I=V/R), under same voltage, the smaller the resistance R is, the greater the resultant current I will be. Furthermore, the smaller resistance R (greater current I) leads to the greater power consumption according to Joule's Law ($P=IV=V^2/R$). Thus, the resistance $r_{20}$ of the shunt 20 is set less than the total resistance $r_{11}$ of the LEDs 11. For example, when the resistance $r_{20}$ of the shunt 20 is 0.03Ω, and the total resistance $r_{11}$ of the LEDs 11 is 0.07Ω (according to the general resistance of normal LED products), the power required by the shunt 20 is $P_{20}=(V^2/0.03)$ while the power required by the LEDs 11 is $P_{11}=(V^2/0.07)$. At this time, due to the equal voltage V in the parallel circuit, the shunt 20, which consumes the greater power, will consume the majority of the residual current in the light emission driving circuit 10 and thus speed up current exhaustion in the LEDs 11.

Figure 1:
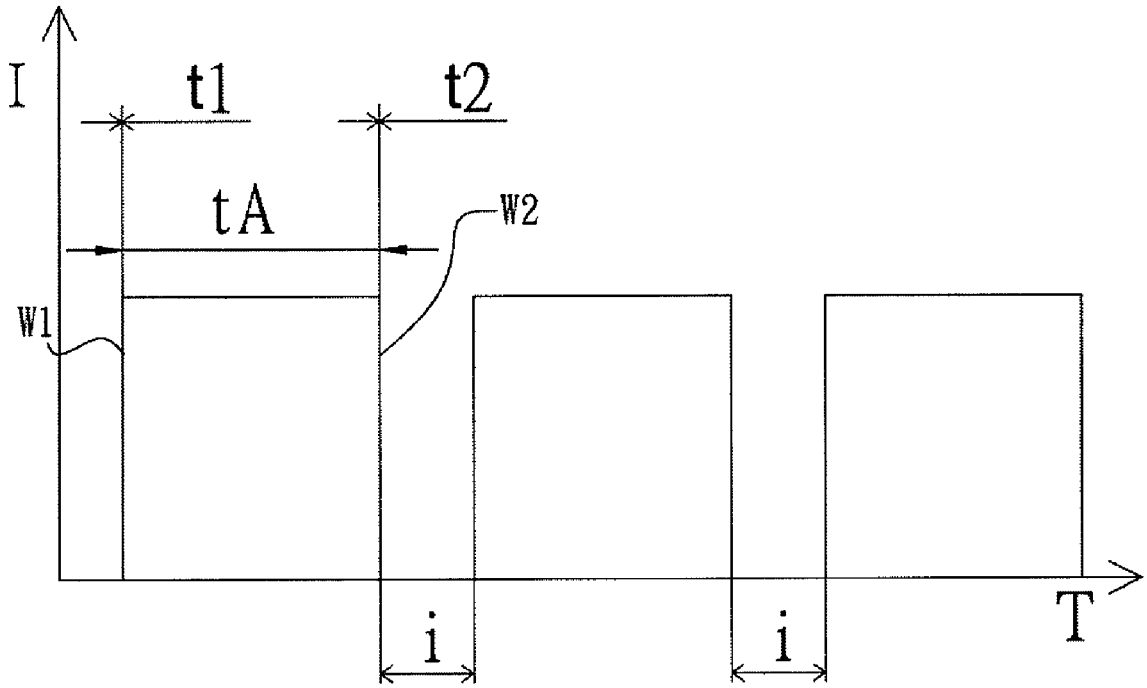
FIG. 1 is a waveform diagram showing an ideal waveform of a PWM signal.
Figure 2:
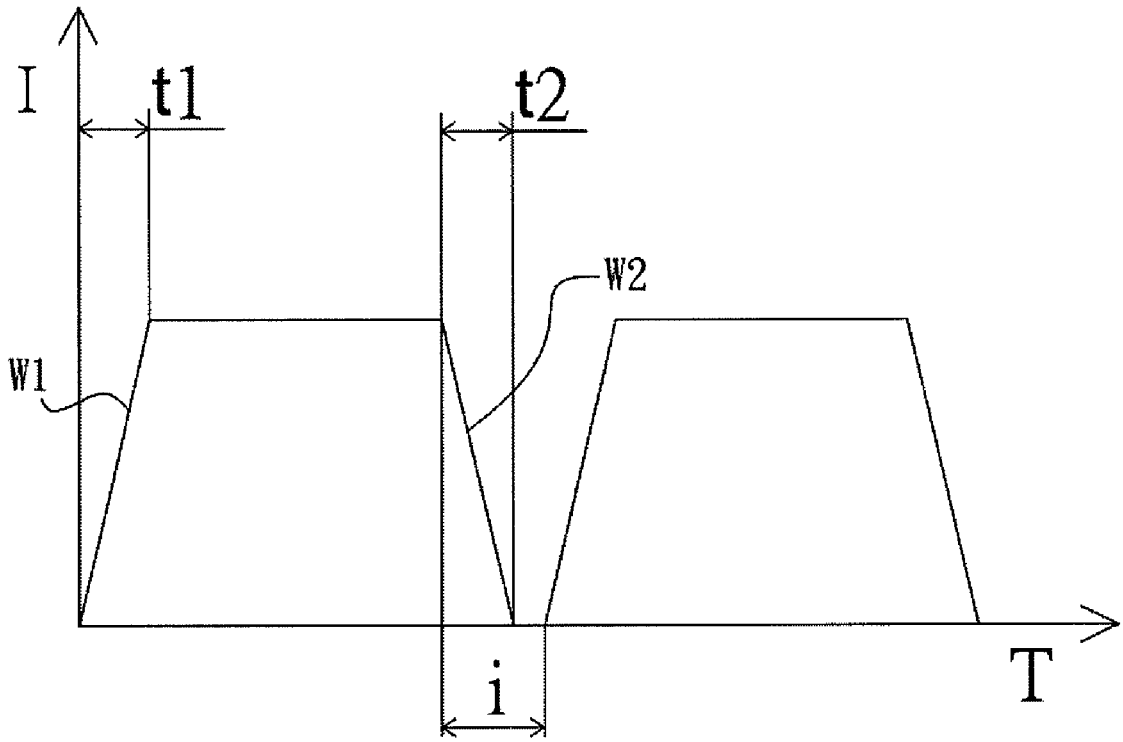
FIG. 2 is a waveform diagram showing a practical waveform of a PWM signal.
Figure 3:
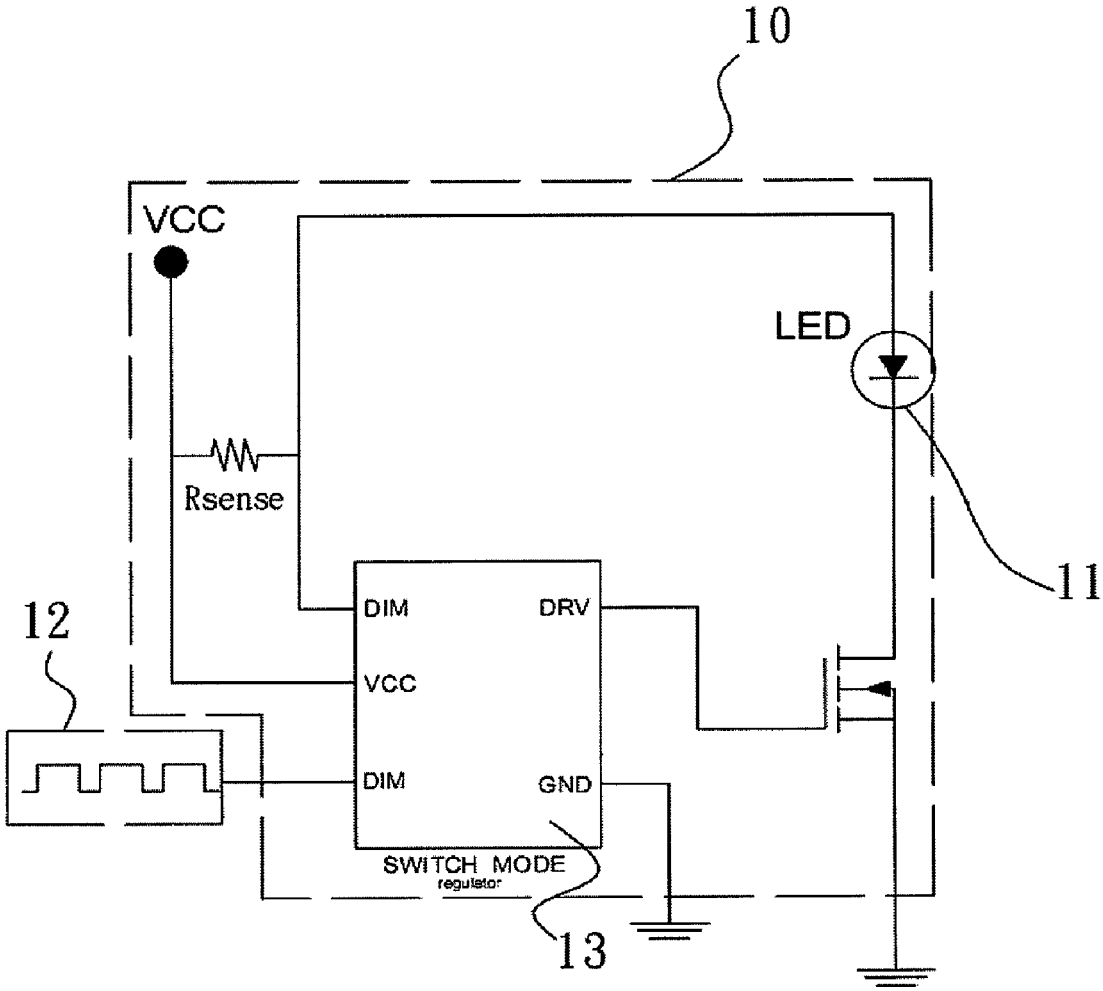
FIG. 3 is a traditional circuit diagram of a driving circuit for LED.

The driving circuit for LED according to the present embodiment generates a PWM signal which waveform is shown in FIG. 7. In FIG. 7, the time t3 compared with the waveform in FIG. 2 of the PWM signal is significantly reduced. And the slope of the trailing edge W2 of the PWM signal is steepened, thereby achieving instant LED shutdown.

Figure 8:
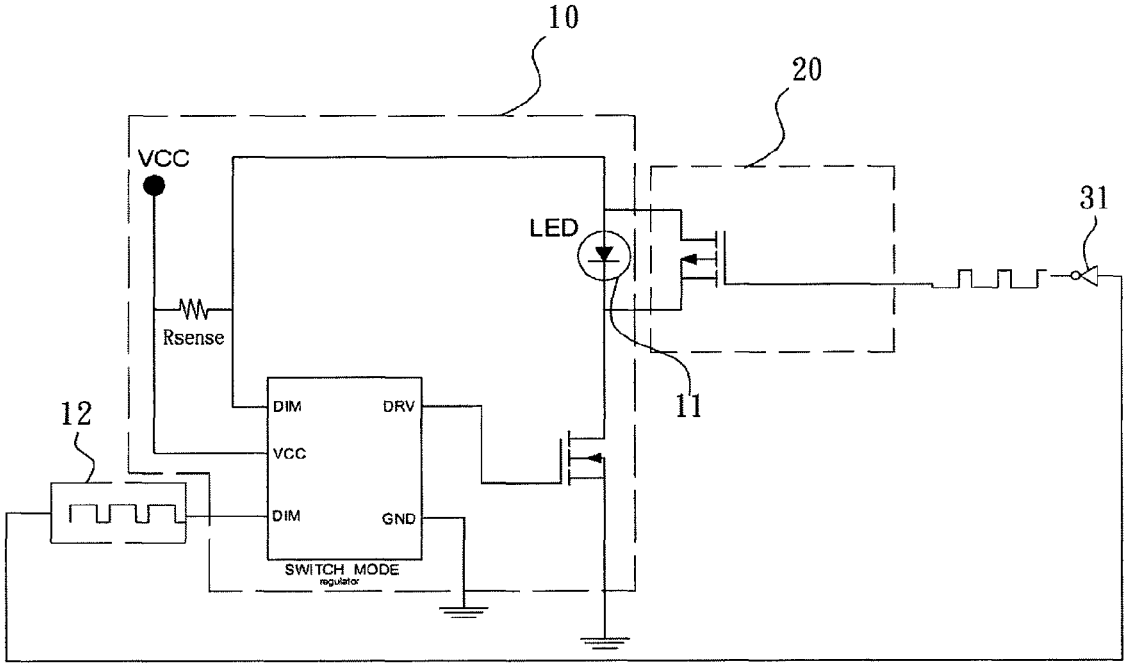
FIG. 8 is a circuit diagram of a driving circuit for LED according to a second embodiment of the present invention, wherein an inverter is used in place of a second PWM unit in the first embodiment.

Please refer to FIG. 8, it shows another embodiment of the driving circuit for LED of the present invention. In FIG. 8, the driving circuit is similar to the driving circuit of FIG. 6 except that the second PWM unit 30 of FIG. 6 is replaced by an inverter 31. For the sake of simplicity, all the similar components in FIGS. 6 and 8 are indicated by the same numerals and are not described repeatedly herein.

As can be seen in FIG. 8, the present embodiment uses the inverter 31 to replace the second PWM unit 30 of FIG. 6. The inverter 31 serves to generate a signal which level is opposite to that of the signal generated by the first PWM unit 12, so as to switch on or off the electrical connection between the shunt 20 and the light emission driving circuit 10. When the first PWM unit 12 generates a high-level signal, the power converting unit 13 synchronously generates a driving current according to the high-level signal generated by first PWM unit 12, thereby light up the LEDs 11. At this time, the inverter 31 generates a low-level signal accordingly so that the electrical connection between the shunt 20 and the light emission driving circuit 10 is switched off. When the signal generated by the first PWM unit 12 is turned to a low level, the driving current signal from the power converting unit 13 is turned into 0, and the signal from the inverter 31 is synchronously turned to a high level. Consequently, the electrical connection between the shunt 20 and the light emission driving circuit 10 is switched on so that the majority of the residual current in the light emission driving circuit 10 is led to the shunt 20, thereby causing the LEDs 11 to turn off instantly.

Figure 4A:
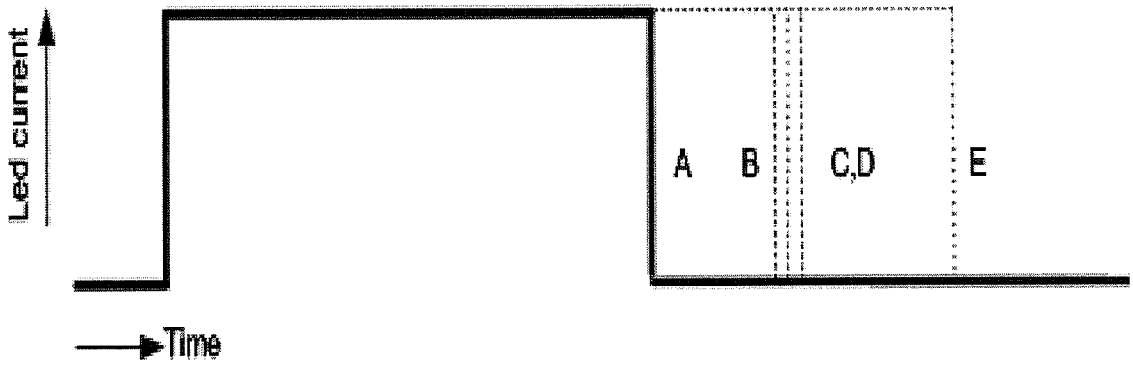
FIG. 4*a* is a diagram showing that the LED current is stopped at time A-E in ideal situation.
Figure 4B:
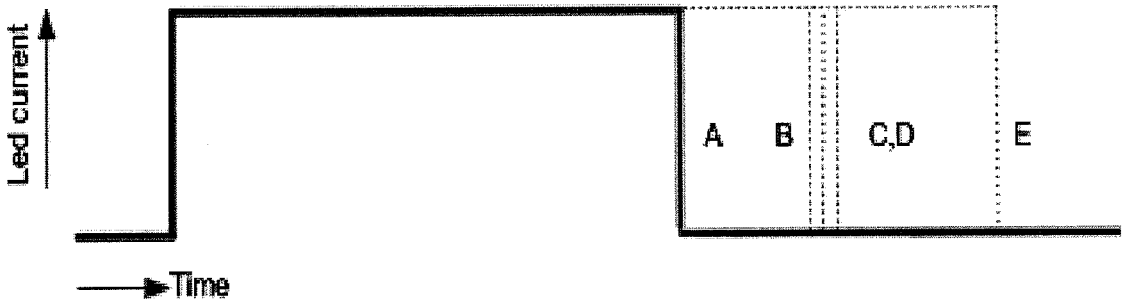
FIG. 4*b* is a diagram showing that the LED current is stopped at time A-E in practical situation.
Figure 5:
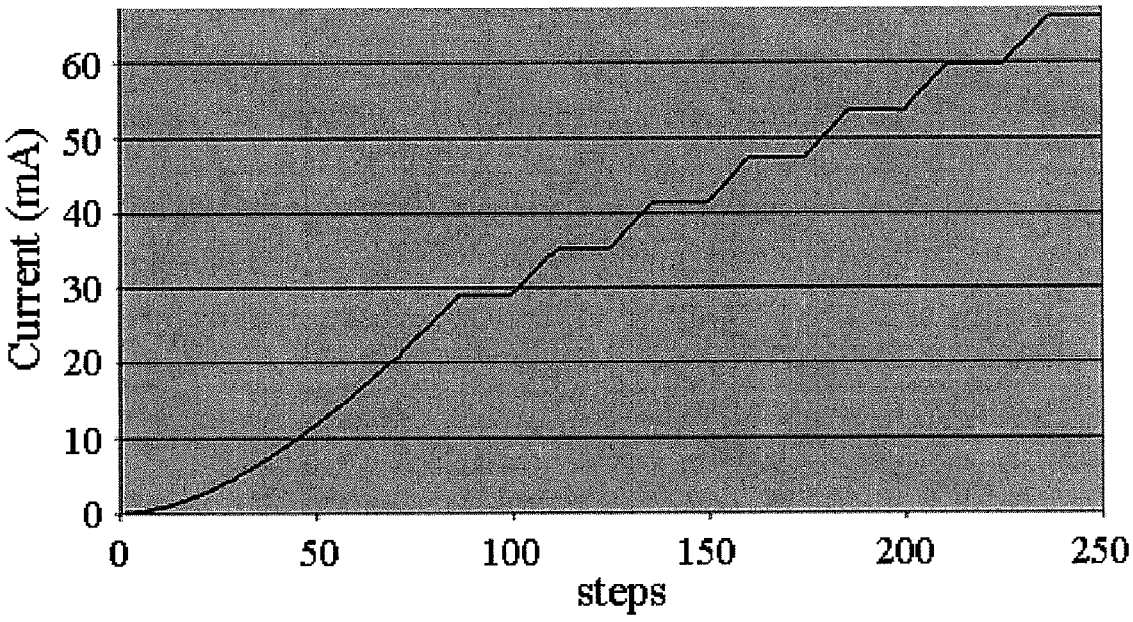
FIG. 5 is a diagram showing a relationship between the PWM step of the PWM unit and the LED current of FIG. 3.
Figure 9:
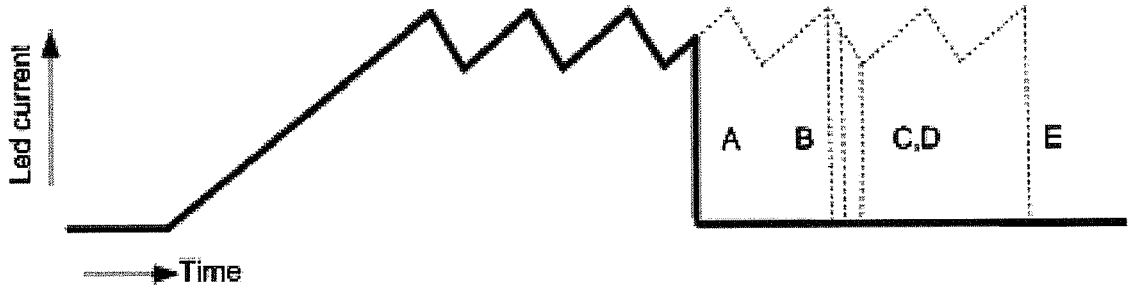
FIG. 9 is a diagram showing that the LED current is stopped at time A-E in the present invention.

In FIG. 9, it shows the LED current is stopped at time A-E in the present invention. In FIG. 9, when the current is stopped at time A-E, the LED is shut down immediately without any time delay. Therefore, there is a clear difference between PWM width of time B, C and D in the short time compared with that of FIG. 4*a*. Hence, the addition of the shunt 20 across the LEDs 11 enables the system to shortcut its terminals during the trailing edge of the current, causing a fast decay of the LED current and consequent linear control shown in FIG. 10.

Figure 10:
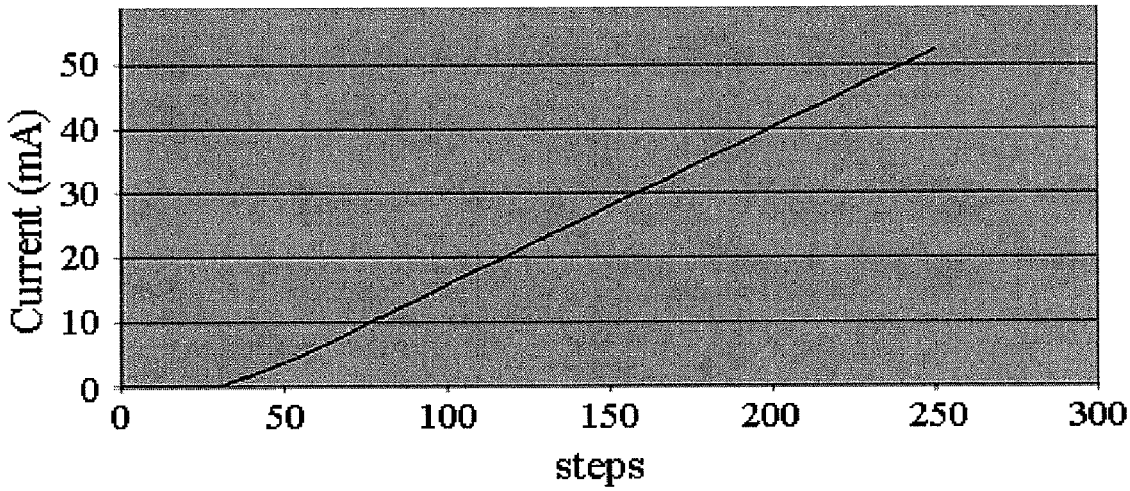
FIG. 10 is a diagram showing a relationship between the PWM step of the second PWM unit and the LED current of present invention.

Referring to FIG. 10, it shows the relationship between the LED current and the PWM step of the second PWM unit. As shown in FIG. 10, by the second PWM unit 30, the LED current would vary with the PWM step linearly. Therefore, the brightness control of the LED is accurate.

By using the driving circuit for LED of the present invention, not only can LEDs be promptly shut down, but also the blinking frequency of the LEDs can be effectively enhanced. Thus the present invention improves the problems related to shadows caused by delayed LED shutdown and the nonlinear control of the LEDs.

Although the invention is described herein in detail by reference to the preferred embodiments, these embodiments are for illustrative purposes only. It will be understood by one of ordinary skill in the art that numerous variations will be possible to the disclosed embodiments without going outside the scope of the invention as defined by the appended claims.

The invention claimed is:

1. A driving circuit for LED comprising:

at least one LED;

a light emission driving circuit having a first PWM unit and a power converting unit, wherein the power converting unit generates a driving current according to a signal generated by the first PWM unit and sends the driving current to the LED;

a shunt connected in parallel with the LED; and a signal generating unit including an inverter for generating a signal to switch on or off an electrical connection between the shunt and the light emission driving circuit, wherein the signal generated by the signal generating unit is at a level opposite to that of the signal generated by the first PWM unit;

wherein when the electrical connection between the shunt and the light emission driving circuit is switched on, the residual current in the light emission driving circuit is led to the shunt.

2. The driving circuit for LED of claim 1, wherein the resistance of the shunt is less than the total resistance of the LED.

3. The driving circuit for LED of claim 1, wherein the signal generating unit causes a linear control of the LED together with high speed PWM.

4. The driving circuit for LED of claim 1, wherein when the signal generated by the signal generating unit is at a high level, the electrical connection between the shunt and the light emission driving circuit is switched on.

5. The driving circuit for LED of claim 1, wherein the light emission driving circuit is for low cost and low consumption power.

* * * * *